US008678944B2

(12) United States Patent
Wall, Jr.

(10) Patent No.: US 8,678,944 B2
(45) Date of Patent: Mar. 25, 2014

(54) VARIABLE LENGTH SHAFT

(75) Inventor: Broadus Perry Wall, Jr., Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 286 days.

(21) Appl. No.: 13/323,539

(22) Filed: Dec. 12, 2011

(65) Prior Publication Data

US 2012/0149486 A1 Jun. 14, 2012

Related U.S. Application Data

(63) Continuation-in-part of application No. 13/009,710, filed on Jan. 19, 2011, now Pat. No. 8,425,345.

(60) Provisional application No. 61/422,982, filed on Dec. 14, 2010.

(51) Int. Cl.
*A63B 53/16* (2006.01)

(52) U.S. Cl.
USPC ..... 473/296; 403/109.3

(58) Field of Classification Search
CPC .. A63B 53/16; A63B 2059/0085; A63B 9/00; F16B 7/10; F16B 7/105; A63C 11/22
USPC ..... 473/239, 296, 298, 299; 280/825; 135/75; 403/109.1, 109.3, 109.7, 403/109.6, 109.8
See application file for complete search history.

(56) References Cited

U.S. PATENT DOCUMENTS

| | | | | |
|---|---|---|---|---|
| 1,419,795 | A * | 6/1922 | Yerger | 473/201 |
| 2,464,850 | A | 3/1949 | Crawshaw | |
| 4,010,958 | A | 3/1977 | Long | |
| 4,340,227 | A | 7/1982 | Dopkowski | |
| 4,415,156 | A | 11/1983 | Jorgensen | |
| 4,688,798 | A | 8/1987 | Pelz | |
| 4,793,616 | A | 12/1988 | Fernandez | |
| 5,294,118 | A | 3/1994 | Iwanaga | |
| 5,470,068 | A | 11/1995 | Schmidt et al. | |
| 5,586,946 | A | 12/1996 | Haber et al. | |
| 5,632,691 | A | 5/1997 | Hannon et al. | |
| 5,951,412 | A | 9/1999 | Rose et al. | |
| 5,997,412 | A | 12/1999 | Benson | |
| 6,086,484 | A | 7/2000 | Uebelhor | |
| 6,343,999 | B1 | 2/2002 | Murtland et al. | |
| 6,375,583 | B1 | 4/2002 | Solheim | |
| 6,558,269 | B1 | 5/2003 | McBee | |

(Continued)

OTHER PUBLICATIONS

Acculength Junior Golf Innovation www.acculength.com/page1332-17104.htm.

*Primary Examiner* — Stephen L. Blau
(74) *Attorney, Agent, or Firm* — Rebecca Hanovice; Michael A. Catania; Sonia Lari

(57) ABSTRACT

A variable length golf club shaft is disclosed herein. The variable length shaft includes a hollow lower shaft with a plurality of holes, a hollow upper shaft with at least one protrusion extending from an inner surface that is sized to fit within the plurality of holes, and an unlocking bar. The shaft length can be adjusted by sliding the upper shaft over the lower shaft and using the unlocking bar to release the protrusion from the holes to allow overall shaft length adjustments. In another embodiment, the variable length shaft includes a hollow lower shaft, a hollow upper shaft, an engaging insert, and a locking bar.

10 Claims, 12 Drawing Sheets

(56) References Cited

U.S. PATENT DOCUMENTS

| | | | | |
|---|---|---|---|---|
| 6,749,521 | B1 | 6/2004 | Benson | |
| 6,755,752 | B2 | 6/2004 | Shimizu | |
| 6,780,120 | B2 | 8/2004 | Murray | |
| 6,796,911 | B2 | 9/2004 | Grace | |
| 6,896,626 | B2 | 5/2005 | Drossos | |
| 6,932,711 | B2 | 8/2005 | Benson | |
| RE38,983 | E | 2/2006 | Antonious | |
| 7,172,514 | B2 | 2/2007 | Benson | |
| 7,510,482 | B2 | 3/2009 | Benson | |
| 7,563,173 | B2 | 7/2009 | Chol | |
| 7,871,337 | B2 * | 1/2011 | Moore | 473/296 |
| 7,874,932 | B2 | 1/2011 | Chol | |
| 8,147,348 | B2 * | 4/2012 | Chol | 473/296 |
| 8,348,783 | B2 * | 1/2013 | Soracco et al. | 473/296 |
| 8,454,451 | B2 * | 6/2013 | Evans et al. | 473/296 |
| 2001/0005696 | A1 | 6/2001 | Hedrick | |
| 2004/0102255 | A1 | 5/2004 | Benson | |
| 2004/0116197 | A1 | 6/2004 | Benson | |
| 2005/0143186 | A1 | 6/2005 | Blattner et al. | |
| 2009/0270197 | A1 | 10/2009 | Holtzman | |
| 2009/0275954 | A1 * | 11/2009 | Phan et al. | 606/104 |
| 2010/0304881 | A1 | 12/2010 | Chol | |
| 2011/0077096 | A1 | 3/2011 | White | |
| 2011/0081984 | A1 | 4/2011 | Beach et al. | |
| 2011/0159982 | A1 | 6/2011 | Takeuchi | |
| 2011/0230277 | A1 | 9/2011 | Chol | |
| 2011/0256949 | A1 | 10/2011 | Soracco et al. | |
| 2012/0036758 | A1 * | 2/2012 | Steffens | 43/12 |
| 2012/0142444 | A1 * | 6/2012 | Chol | 473/296 |
| 2013/0264799 | A1 * | 10/2013 | Taylor et al. | 280/647 |

* cited by examiner

VARIABLE LENGTH SHAFT

CROSS REFERENCES TO RELATED APPLICATIONS

The present application is a continuation-in-part of U.S. patent application Ser. No. 13/009,710, filed on Jan. 19, 2011, which claims priority to U.S. Provisional Patent Application No. 61/422,982, filed on Dec. 14, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a variable length shaft assembly that allows for quick, semi-permanent length adjustments. More specifically, the present invention relates to a variable length shaft whose length can be adjusted in a short period of time with the use of a simple tool and without the use of many different components.

2. Description of the Related Art

Customization of golf clubs to help golfers attain better shots has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, and club length.

Current technology provides two methods to adjust overall club length. One such method involves damage to or destruction and removal of the grip on a shaft. Upon removal of the grip by tearing or peeling, the end portion of the shaft can be trimmed or otherwise cut to decrease the club length, or an extension piece can be affixed to the end of the shaft to increase its length. Aftermarket extensions are available specifically for this purpose; alternatively, extensions can be made from portions of other golf club shafts that are cut to the desired length and then inserted into the end of the first club's shaft. The extension piece must match the diameter of the existing shaft, so it is necessary at times to build up the diameter of the extension or existing shaft by adding layers of tape. This method requires that the user making the adjustments have access to potentially expensive new components and tools as well as having a high level of skill. It also causes damage to the shaft and the grip.

The second method of adjusting club length involves replacing the entire shaft and grip using a semi-permanent head-shaft connection device that some manufacturers offer with their clubs, particularly with drivers. The existing shaft may be removed from the driver head and replaced with a different shaft that has either a shorter or longer length. This method is not possible on all clubs, however, as the head must have hardware that allows for removal of the shaft and replacement with a new shaft without damaging the head.

A golfer who does not possess club altering skills or the necessary disposable income to purchase new components likely will be daunted by these two methods of adjusting club length. The first method requires the golfer to make use of several tools to remove the grip and cut the shaft if he or she desires a shorter length, and also to have materials such as tape and a replacement grip on hand. The skill set required to change the shaft length using this method is usually beyond the abilities of the average golfer, so the golfer would need to seek the services of a golf club fitter or technician to have their club length changed. The second method requires the golfer to buy an entirely new shaft at a different length, which can be very expensive, and also may require the golfer to retain a golf club fitter or technician to replace the shaft.

Ultimately, the two methods described above require an inventory of spare components and above average technical skill, particularly with regard to the first method. It is therefore desirable to facilitate the change of a club's length using a faster, easier, and less expensive method than is currently available.

BRIEF SUMMARY OF THE INVENTION

One aspect of the present invention is a variable length golf club shaft comprising a hollow upper shaft comprising a wall having a plurality of holes, a hollow lower shaft comprising a wall having a plurality of holes, a hollow engaging insert comprising an expanding portion having at least one protrusion sized to fit within one or more of the plurality of holes on each of the upper shaft and lower shaft, a grip, and a locking bar, wherein the engaging insert is disposed within the upper shaft, wherein the upper shaft is sized to slidably receive the lower shaft, wherein a portion of the lower shaft is disposed between a portion of the upper shaft and a portion of the engaging insert, and wherein inserting the locking bar into the engaging insert causes the expanding portion to expand, the at least one protrusion to engage with at least one of the plurality of the holes on each of the upper shaft and the lower shaft, and the portion of the lower shaft to press against the portion of the upper shaft.

In a further embodiment, each of the upper shaft and the lower shaft may comprise a longitudinal axis, and the plurality of holes on each of the upper shaft and the lower shaft may be arranged along the longitudinal axes of the upper shaft and the lower shaft. The plurality of holes on the lower shaft may comprise at least ten holes each on at least two opposing sides of the lower shaft wall, and the plurality of holes on the upper shaft may comprise at least three holes each on at least two opposing sides of the upper shaft wall. The engaging insert may further comprise two prongs, wherein each of the prongs comprises at least one protrusion, and wherein the prongs are pulled toward each other by an expandable band, and inserting the locking bar into the engaging insert may stretch the expandable band and push the prongs away from each other.

In another further embodiment, each of the upper shaft, lower shaft, engaging insert, and locking bar is composed of a composite material, and the grip is affixed to an external surface of the upper shaft. The variable length golf club shaft may further comprise a weighted cap, wherein the upper shaft comprises an opening at an upper end and an opening at a lower end, wherein the opening at the lower end receives the lower shaft, and wherein the opening at the upper end receives the weighted cap. Sliding the upper shaft along the lower shaft may adjust an overall length of the variable length golf club shaft over a range of 3 inches. In a further embodiment, the upper shaft may comprise a slit along a longitudinal axis to accommodate sliding along the lower shaft, and the lower shaft may comprise a locating clip that mates with the slit and prevents the upper shaft from twisting when it slides along the lower shaft.

Another aspect of the present invention is a variable length golf club shaft comprising a hollow lower shaft comprising a wall having a plurality of holes, a hollow upper shaft comprising an exterior surface and an interior surface, wherein the interior surface comprises at least one protrusion sized to fit within at least one of the plurality of holes, and wherein the upper shaft is sized to slidably receive the lower shaft and an unlocking bar sized to fit within the upper shaft and the lower shaft, wherein sliding the upper shaft over the lower shaft causes the protrusion to engage with at least one of the plurality of holes, wherein engagement of the protrusion with one or more of the plurality of holes fixes the upper shaft to the lower shaft, and wherein inserting the unlocking bar into the upper shaft and the lower shaft when the upper shaft is fixed to the lower shaft disengages the protrusion from the one or more plurality of holes and permits the upper shaft to move along a length of the lower shaft.

In a further embodiment, the plurality of holes may comprise at least ten holes each on at least two opposing sides of the lower shaft wall, and the interior surface of the upper shaft may comprise at least three protrusions each on at least two opposing sides of the interior surface. The plurality of holes may be arranged along a longitudinal axis of the lower shaft, and the protrusions may be arranged along the longitudinal axis of the upper shaft, and sliding the upper shaft along the lower shaft may adjust an overall length of the variable length golf club shaft over a range of 3 inches. The upper shaft and lower shaft may each be composed of a composite material, and a grip may be affixed to the exterior surface of the upper shaft. The variable length golf club shaft may further comprise a weighted cap received by an opening at the upper end of the upper shaft.

Yet another aspect of the present invention is variable length golf club shaft comprising a hollow upper shaft composed of a composite material, the upper shaft comprising an exterior surface, an interior surface, a longitudinal axis, a plurality of protrusions arranged along the longitudinal axis on opposing sides of the interior surface, a slit extending along the longitudinal axis, an open upper end, and an open lower end, a hollow lower shaft composed of a composite material and sized to fit within the upper shaft, the lower shaft comprising a wall, a plurality of through holes arranged along a longitudinal axis on opposing sides of the wall, an open upper end, and a lower end for engagement with a golf club head, a locating clip disposed at the open upper end of the lower shaft, the locating clip comprising a protruding edge that mates with the slit, a grip affixed to the exterior surface of the upper shaft, the grip comprising an open upper end, a cap sized to fit within the open upper end of the grip and the open upper end of the upper shaft, and an unlocking bar sized to fit within the lower shaft and the upper shaft, wherein inserting the lower shaft into the upper shaft so that the protrusions interact with the plurality of through holes fixes the upper shaft to the lower shaft, and wherein inserting the unlocking bar into the upper shaft and the lower shaft when the upper shaft is fixed to the lower shaft pushes the protrusions out of the plurality of through holes and permits the upper shaft to move along a length of the lower shaft.

In a further embodiment, the cap may comprise external threads, the open upper end of the upper shaft may comprise internal threads sized to receive the external threads, and the cap may be weighted to adjust the overall weight of the variable length golf club shaft. The grip may also be composed of a rubber material, and the locating clip may be composed of a lightweight metal material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
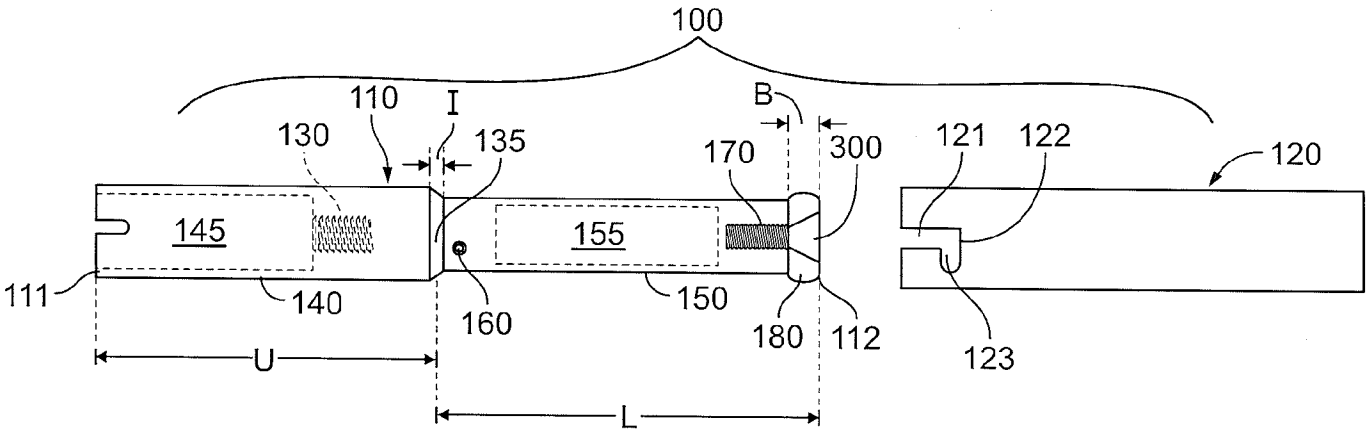
FIG. 1 is a side plan view of an unassembled first embodiment of the variable length shaft of the present invention.

The present invention is directed to a variable length shaft and grip that provides club length adjustability. Club length adjustability is an advantageous feature for golf clubs, because, for example, extending the length of a club can have the desired effect of increasing club head speed, which results in longer driving distances. Conversely, shortening the length of a club would provide a golfer with more control and accuracy in driving the golf ball. Golf course conditions often require accurate driving due to hazards, including but not limited to water, rough, sand, and out of bounds markers, and driving accuracy can be more preferred than driving distance in competitive situations.

The present invention is also valuable because a golfer's swing may change over time, thus requiring alterations to his or her clubs. A golfer may improve his or her game through lessons and may gain greater flexibility and strength through practice and exercise. As such, it is reasonable for a golfer to wish to change his or her club's length to help improve accuracy, distance, and feel as needed or desired.

The present invention provides golfers with a system and method to easily, quickly and inexpensively modify the length of their golf clubs to have them perform in a desired manner. This invention will enable golfers to change their club length wherever they wish, including, but not limited to, at the practice range, the golf course, and their home. The present invention also is designed to avoid altering a club's swing weight or its "feel." The components used to alter a club's length in the present invention are small and can be carried in a pocket of the user's golf bag. Furthermore, the technical ability required to modify the golf club length according to this invention is minimal and its approach is intuitive and easy for a golfer to understand.

FIGS. 1-9 show a first embodiment of the present invention. This embodiment comprises a two-part shaft 100 having upper 110 and lower 120 sections, a two-part grip 200 having upper 210 and lower 220 sections, and a locating clip 400 to secure the upper shaft section 110 to the lower shaft section 120. In this embodiment, a user can remove the upper shaft and grip sections 110, 210 from the lower shaft and grip section 120, 220 and replace them with upper shaft and grip sections 110, 210 having different overall lengths and/or weights.

Figure 3:
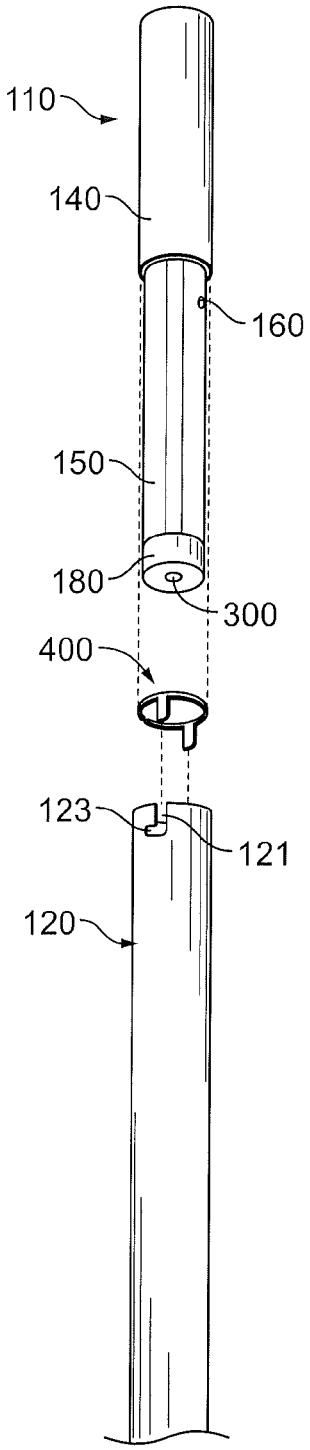
FIG. 3 is a side plan view of the variable length shaft shown in FIG. 1
Figure 4:
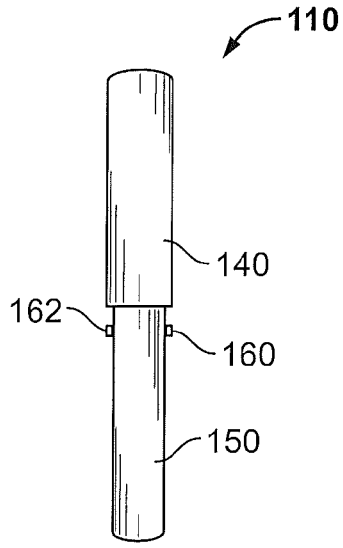
FIG. 4 is a side plan view of an upper shaft portion of the embodiment shown in FIG. 3.

As shown in FIGS. 1, 3, and 4, the upper shaft 110, which has proximal 111 and distal ends 112 and proximal and distal portions 140, 150, includes a threaded hole 130 located in the proximal portion 140. As shown in FIG. 1, the threaded hole 130 extends from a hollow interior portion 145 located in the proximal portion 140 of the upper shaft 110 toward the distal portion 150. In an alternative embodiment, the threaded hole 130 may extend from the furthest extent of the proximal end 111 toward the distal portion 150. One or more weights (not shown) may optionally be placed in the hollow interior 145 of the proximal portion 140 to affect swing balance.

As shown in FIG. 1, the proximal portion 140 of the upper shaft 110 has a length "U." In the preferred embodiment, a user can separate the upper shaft 110 from the lower shaft 120 and replace the upper shaft 110 with another upper shaft piece having a different "U" length. In this way, a user can change the overall length of the shaft 100 without changing the lower shaft 120, i.e, without having to handle a golf club head (not shown). The proximal and distal portions 140, 150 of the upper shaft 110 are separated by an intermediate portion 135, which, in the preferred embodiment, has a length "I" of approximately 0.125 inches. The length I remains the same across varying lengths of upper shaft pieces in the preferred embodiment, but in an alternative embodiment this length I may vary depending on the upper shaft 110 selected.

As shown in FIGS. 1, 3, and 4, the distal portion 150 of the upper shaft 110 includes at least one protruding pin 160, which has a diameter of 0.080 inches, and also comprises a hollow interior portion 155, which can optionally hold weights (not shown) or be left empty to reduce the overall weight of the shaft 100. In the preferred embodiment, the upper shaft 110 has two protruding pins 160, 162, shown in FIG. 4, each of which has a diameter of approximately 0.080 inches. In the preferred embodiment, the distal portion 150 has a length "L" of approximately 2.250 inches, but in other embodiments this length may vary depending on the upper shaft 110 selected by the user.

As shown in FIG. 1, in the preferred embodiment the distal portion 150 further includes a threaded bore 170 originating at the distal end 112 of the upper shaft 110, and an expandable bushing 180 having a through hole is affixed to the distal end 112 with a bolt 300. See also FIGS. 3 and 7. The expandable bushing 180 may, in alternative embodiments, be affixed to the distal end 112 using adhesives or other methods. The expandable bushing 180 preferably is composed of a polymer, particularly 65 Shore D urethane, and has a length "B" of approximately 0.250 inches. In other embodiments, the expandable bushing 180 is composed of neoprene or plastic. The expandable bushing 180 helps to secure, via friction, the upper shaft 110 to the lower shaft 120 when the upper and lower shaft pieces 110, 120 are assembled as disclosed herein.

Figure 5:
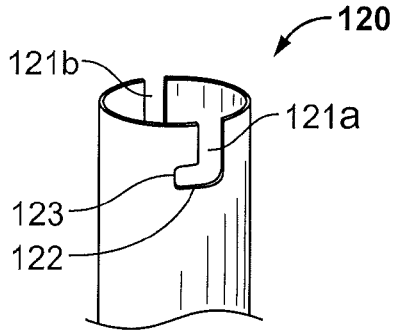
FIG. 5 is an enlarged, side perspective view of part of the lower shaft portion of the embodiment shown in FIG. 3.
Figure 6:
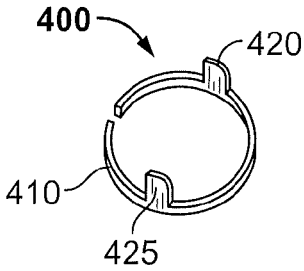
FIG. 6 is a side perspective view of the locating clip shown in FIG. 3.
Figure 7:
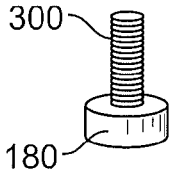
FIG. 7 is a side perspective view of the expandable bushing shown in FIG. 3.

As shown in FIGS. 1, 3, and 5, the lower shaft 120 comprises at least one notch 121. In the embodiment shown in FIG. 5, the lower shaft 120 comprises two notches 121*a*, 121*b*, to receive the two pins 160, 162. The lower shaft 120 is hollow and has a diameter that is greater than the diameter of the distal portion 150 of the upper shaft 110. To assemble the upper shaft 110 with the lower shaft 120, the distal portion 150 of the upper shaft 110 is inserted into the hollow interior of the lower shaft 120 and is oriented such that the pins 160, 162 slide into the notches 121*a*, 121*b*. Once the pins 160, 162 come into contact with the ends 122, (not shown) the notches 121*a*, 121*b*, the upper shaft 110 is twisted such that the pins 160, 162 are engaged by side channels 123, (not shown) of the notches 121*a*, 121*b*.

Figure 8:
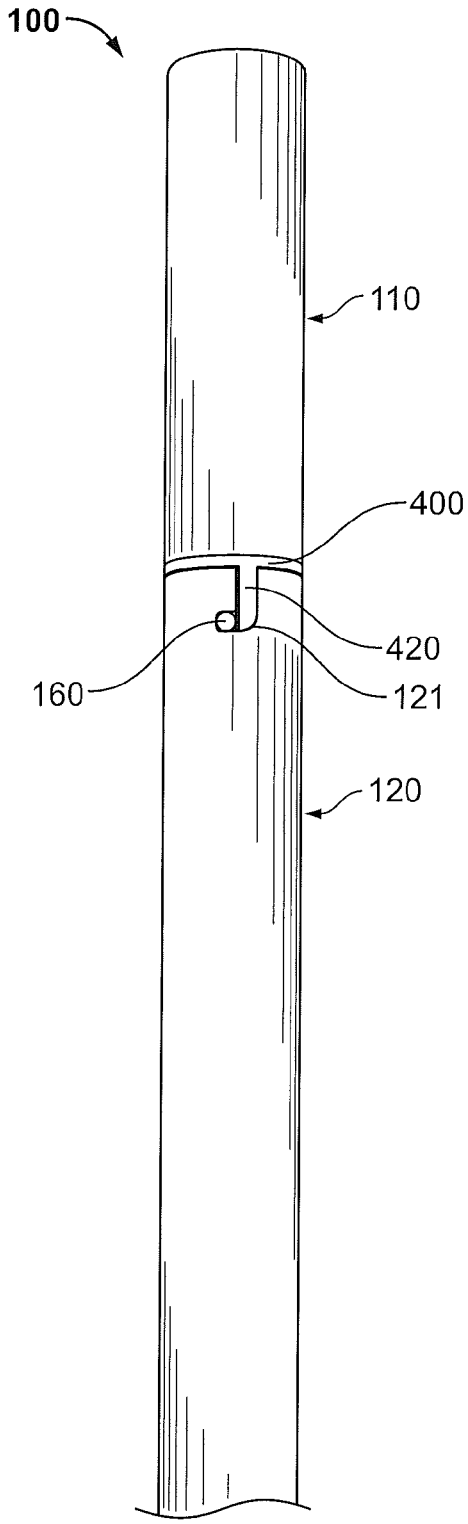
FIG. 8 is a side plan view of the embodiment shown in FIG. 3 in assembled form.

Once the upper and lower shaft pieces 110, 120 are assembled as described above, the locating clip 400, shown in FIGS. 3 and 6, is applied to secure the pieces. The locating clip 400 comprises a circular piece of material 410, preferably metal, and more preferably titanium alloy, which has at least one prong 420 extending perpendicularly away from the circular material 410. In the preferred embodiment, the locating clip has two prongs 420, 425. The locating clip 400 is slid over the proximal end 111 of the upper shaft piece 110, and the prongs 420, 425 are fitted into the notches 121*a*, 121*b* to prevent the pins 160, 162 from moving out of the side channels 123, (not shown) and back into the notches 121*a*, 121*b*. FIG. 8 shows the upper and lower shaft pieces 110, 120 in fully assembled form with the locating clip 400 in place.

Figure 2:
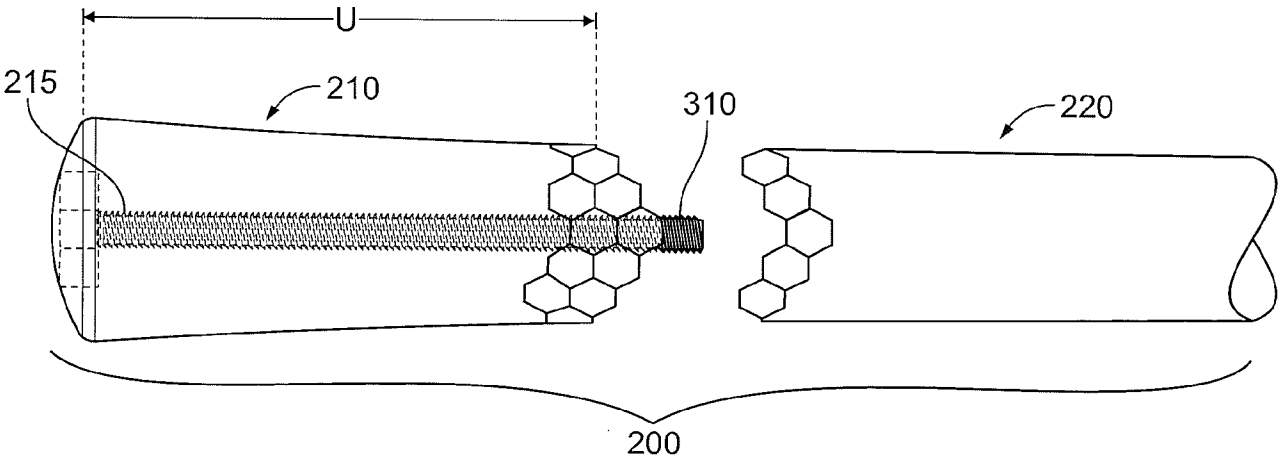
FIG. 2 is a side plan view of a grip to be used with the variable length shaft shown in FIG. 1
Figure 9:
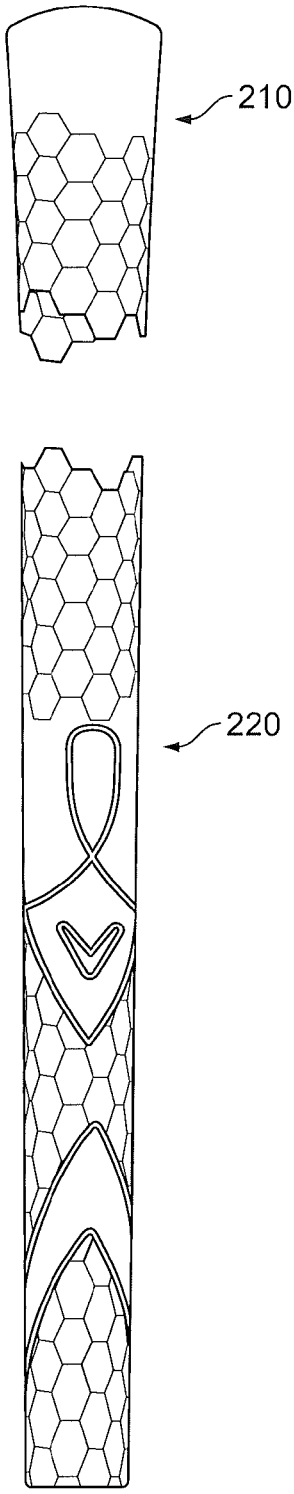
FIG. 9 is a side perspective view of the grip shown in FIG. 2.

The grip pieces 210, 220 of the present invention are shown in FIGS. 2 and 9. As shown in FIG. 2, the upper grip 210 includes a hole 215 that spans the length "U" of the upper grip 210 and receives a bolt 310. The upper grip 210 is installed on the upper shaft 110 by sliding the upper grip 210 over the upper shaft 110 so that the upper grip 210 encircles at least the upper portion 140, inserting the bolt 310 into the upper grip hole 215 and engaging the bolt 310 with the threads of the upper shaft hole 130. Tightening the bolt 310 removably secures the upper grip 210 to the upper shaft 110 and holds the locating clip 400 in place. When the bolt 310 is removed, the upper grip section 210 can be removed from the upper shaft section 110. The lower grip 220 is installed on the lower shaft 120 using double sided tape or another type of adhesive. Alternatively, in another embodiment, the upper grip 210 is affixed to the upper shaft portion 110 with double sided tape or adhesive.

Figure 10:
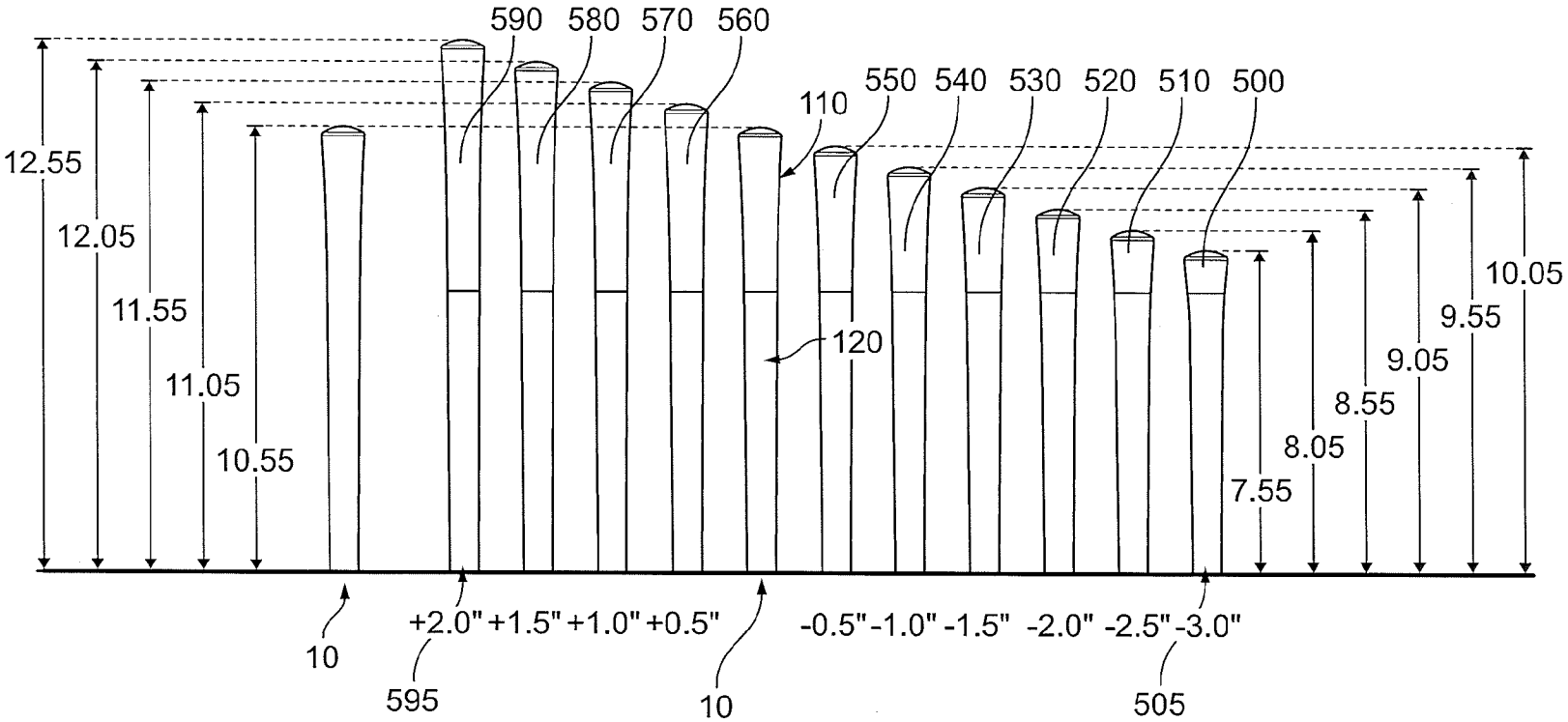
FIG. 10 is a side view of different lengths of upper shaft sections of the variable length shaft of the present invention.
Figure 11:
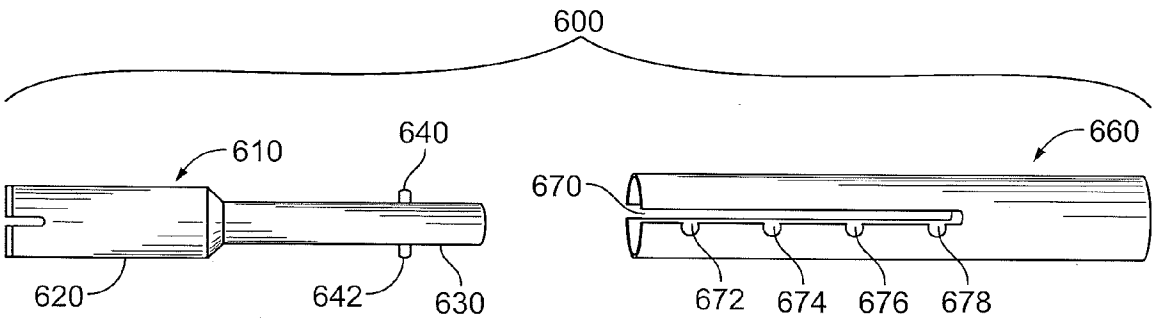
FIG. 11 is a side plan view of an unassembled second embodiment of the present invention.

FIG. 10 shows that the lengths of the lower shaft sections 120 are not altered in the embodiments of the present invention. In other words, a golfer would not exchange the lower shaft piece 120 for a lower shaft piece 120 of a different length. The lower shaft piece 120 of the present invention thus can be permanently affixed to a desired golf club head (not shown). In contrast, according to the first embodiment of the present invention and as disclosed in FIG. 10, the upper shaft section 110 of a normal length club 10 can be easily swapped for other upper shaft sections 500, 510, 520, 530, 540, 550, 560, 570, 580, 590, having different overall lengths. The upper shaft sections 500-590 can also have different weights to allow the golfer to change the overall club weight as desired.

FIG. 10 discloses an assortment of upper shaft sections, each having different lengths so that the total club length of the first and second embodiments can range from a short, 43-inch club 505 to a long, 48-inch club 595. These upper shaft sections can be sold to golfers in kit format along with a lower shaft section 120. As such, if a golfer wishes to increase the length of a shaft, he or she may remove the upper shaft section 110 and replace it with an upper shaft section having a greater length 560, 570, 580, 590. In contrast, if the golfer wishes to decrease the length of the shaft, he or she may remove the upper shaft section 110 and replace it with an upper shaft section having a shorter length 500, 510, 520, 530, 540, 550. The embodiments of this invention thus allow the golfer to increase or decrease the length of a golf club shaft without detaching the lower shaft section 210 from the club head or cutting or damaging any part of the shaft.

A second embodiment of the present invention, which does not require multiple upper shaft or grip pieces having varying lengths, is shown in FIGS. 11 and 12A-12C. A variable length shaft 600 has an upper shaft piece 610 and a lower shaft piece 660. The upper shaft piece is similar in structure to the upper shaft piece 110 shown in FIG. 1, as it has an upper portion 620, a lower portion 630, and one or more pins 640, 642 located on the lower portion 630. The lower shaft piece 660 has at least one notch 670 sized to hold the one or more pins 640, 642. In this embodiment, the at least one notch 670 has more than one side channel 672, 674, 676, 678, within which the pins 640, 642 can fit.

Figure 12C:
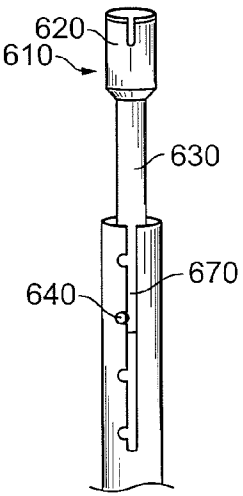
FIGS. 12A, 12B, 12C are side plan views of different assemblies of the embodiment shown in FIG. 11.
Figure 12B:
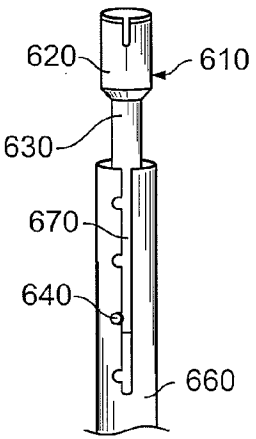
Figure 12A:
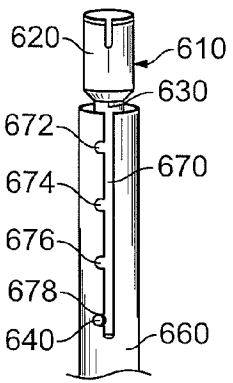

To assemble this embodiment, the lower portion 630 of upper shaft piece 610 is inserted in the hollow interior of the lower shaft piece 660 such that the pins 640, 642 slide into the at least one notch 670. When the combination of the lower and upper shaft pieces 610, 660 equals a desired overall shaft length, the upper shaft piece 610 is twisted so that the one or more pins 640, 642 slide into the selected side channel 672, 674, 676, 678, as shown in FIGS. 12A, 12B, and 12C. If a user wishes to change the overall length of the shaft 600, the upper shaft piece 610 is twisted again so that the one or more pins 640, 642 leave the selected side channel 672, 674, 676, 678. A locating clip (not shown) may be used to prevent the pins 640, 642 from leaving the selected side channel 672, 674, 676, 678. Once the user achieves the desired overall shaft 600 length and locks the pins 640, 642 within the selected side channel 672, 674, 676, 678, a grip is sized and fitted to the shaft 600.

A third embodiment of the present invention, which also does not require multiple upper shaft or grip pieces having varying lengths, is shown in FIGS. 13, 14A, 14B, 15A, and 15B. A variable length shaft 1000 has an upper shaft piece 1110 and a lower shaft piece 1120, each of which is hollow. The upper shaft piece 1110 has an open upper end 1111, an open lower end 1112, and a plurality of holes 1115 that extend through the wall of the upper shaft piece 1110, preferably on at least two, opposite sides of the upper shaft piece 1110 proximate the open lower end 1112. The external surface of the upper shaft piece also has a grip 2000 affixed to it, preferably by an adhesive.

The lower shaft piece 1120 also has an open upper end 1122, a lower end 1121 that can be engaged with a golf club head 50, and a plurality of holes 1125 that extend through the wall of the lower shaft piece 1120, preferably on at least two, opposite sides of the lower shaft piece 1120, proximate the open upper end 1122 of the lower shaft piece 1120. The lower shaft piece 1120 has a diameter that is slightly smaller than the innermost diameter of the upper shaft piece 1110 so that the lower shaft piece 1120 can be snugly inserted into the upper shaft piece 1110.

Figure 13:
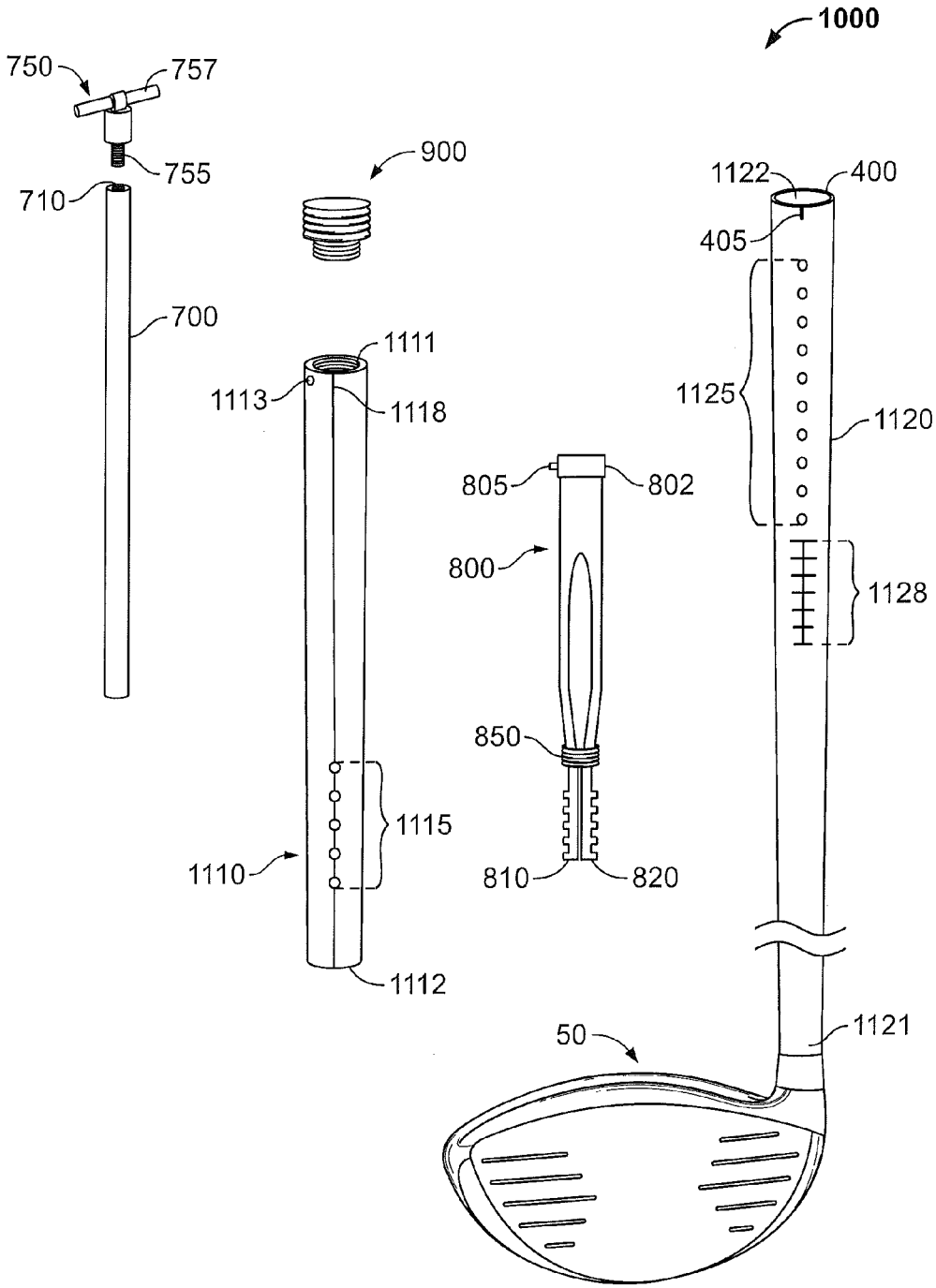
FIG. 13 is an unassembled, side plan view of the parts of a third embodiment of the present invention.

As shown in FIG. 13, the plurality of holes 1115, 1125 on both the upper and lower shaft pieces 1110, 1120 are arranged along a longitudinal axis of the shaft pieces 1110, 1120, and can be aligned when the lower shaft piece 1120 is inserted into the open lower end 1112 of the upper shaft piece 1110. By sliding the upper shaft piece 1110 over the lower shaft piece 1120, different holes from the plurality of holes 1125 on the lower shaft piece 1120 line up with the plurality of holes 1115 of the upper shaft piece 1110, and different overall lengths of the variable length shaft 1000 can be achieved based on the holes 1125 selected. The lower shaft piece 1120 preferably includes length markings 1128 on its exterior surface, proximate to or below the plurality of holes 1125, so that a user can determine how far to slide the upper shaft piece 1110 along the lower shaft piece 1120 in either direction. The lower shaft piece 1120 also preferably includes a locating clip 400 with a protruding edge 405 disposed at its open upper end 1122. The protruding edge 405, which preferably is 0.040 inch wide and 0.030 inch long, engages a longitudinal slit 1118 through the side of the upper shaft piece 1110 and prevents the upper shaft piece 1110 from twisting as it is slid up or down along the lower shaft piece 1120.

Figure 14A:
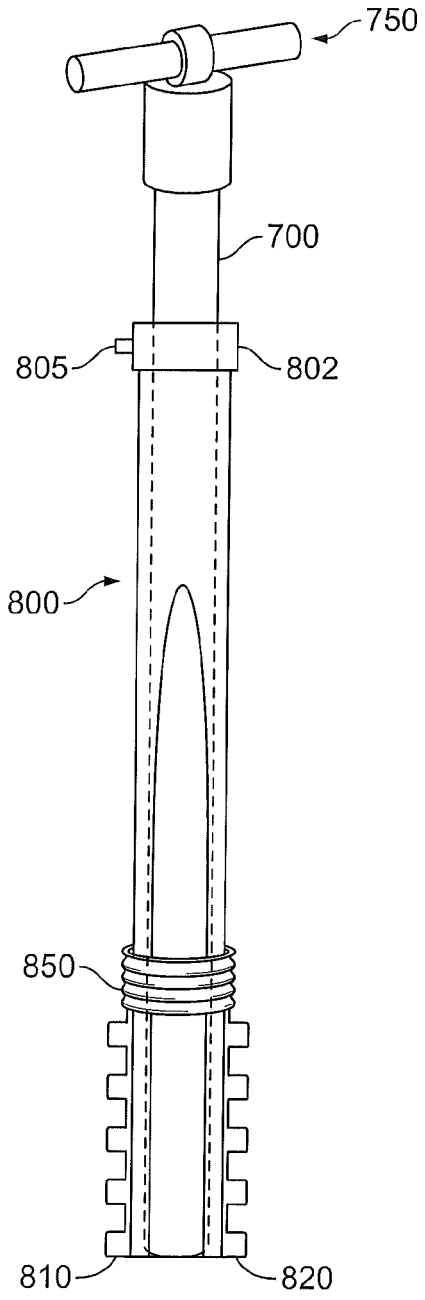
FIGS. 14A and 14B are side plan views of the locking bar interacting with the engaging insert of the embodiment shown in FIG. 13.
Figure 14B:
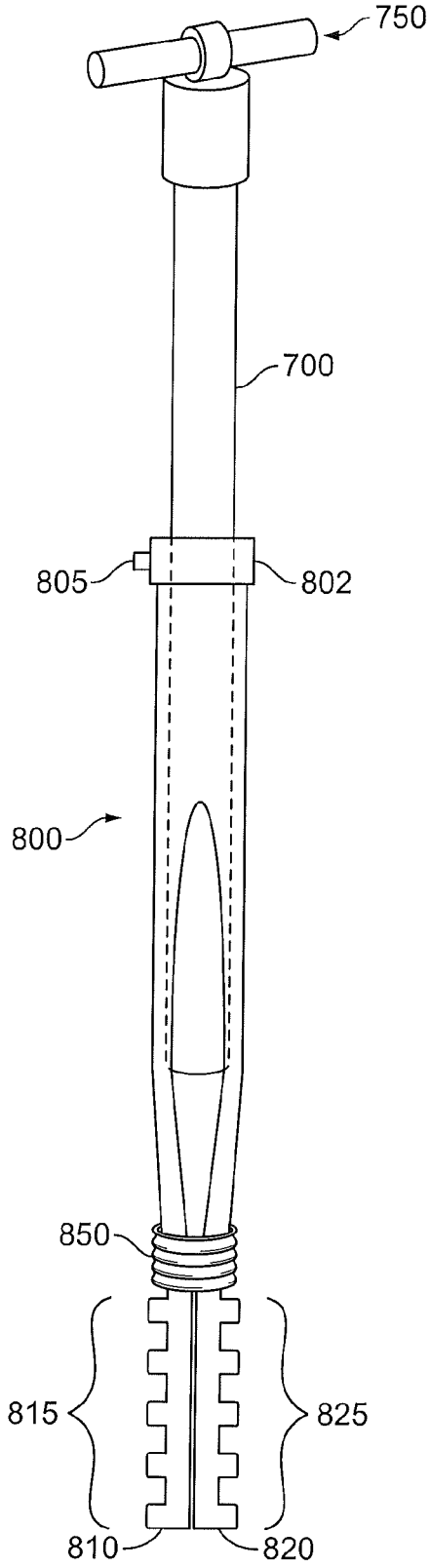

The embodiment shown in FIGS. 13-14B also comprises a hollow engaging insert 800 that is used to fix the upper shaft piece 1110 to the lower shaft piece 1120 when the variable length shaft 1000 has a desired overall length. The engaging insert 800, shown in more detail in FIGS. 14A and 14B, is preferably fixed within the upper shaft piece 1110 so that the pieces can be used as a unit. The engaging insert 800 may be affixed to the upper shaft piece 1110 by adhesive, or more preferably by a locking pin 805 protruding from an upper shelf portion 802 of the engaging insert 800. In this configuration, the upper shelf portion 802 rests against the open upper end 1111 of the upper shaft piece 1110, while the locking pin 805 engages a locking hole 1113 located proximate the open upper end 1111 of the upper shaft piece 1110. This configuration makes it difficult, but not impossible, for a user to disengage the engaging insert 800 from the upper shaft piece 1110. The locking pin 805 may be retained within the upper shelf portion 802 by any means, including a clip, which is preferably made of urethane.

When the variable length shaft 1000 is assembled as described herein and shown in the Figures, and a user has selected a desired overall length by sliding the upper shaft piece 1110 over the lower shaft piece 1120, the user can semi-permanently fix the shaft pieces 1110, 1120 together by threading a locking bar 700 through the engaging insert 800, causing the engaging insert 800 to expand and to press the lower shaft piece 1120 against the upper shaft piece 1110, as shown in FIGS. 14A and 14B. In a preferred version of this embodiment, the engaging insert 800 comprises two prongs 810, 820, which are spaced from each other when the locking bar 700 is inserted into the engaging insert 800 and are pressed against each other when the locking bar 700 is removed. The prongs 810, 801 are held together by an elastic connector 850, which may be a rubber or urethane band. The locking bar 700 stretches the elastic connector 850 and pushes the prongs 810, 820 apart when engaged with the engaging insert 800.

The locking bar 700 can be inserted into and removed from the engaging insert 800 by any means, but is preferably inserted or removed using a tool 750. In the embodiment shown in FIGS. 13, 14A, and 14B, the locking bar 700 is a hollow tube having internal threads proximate an upper opening 710. The tool 750 has matching external threads 755 that mate with the internal threads to connect the tool 750 to the locking bar 700. The tool also has a handle 757 that allows a user to push the locking bar 700 into or pull the locking bar 700 out of the engaging insert 800. The threads may be reversed in an alternative embodiment.

Figure 15A:
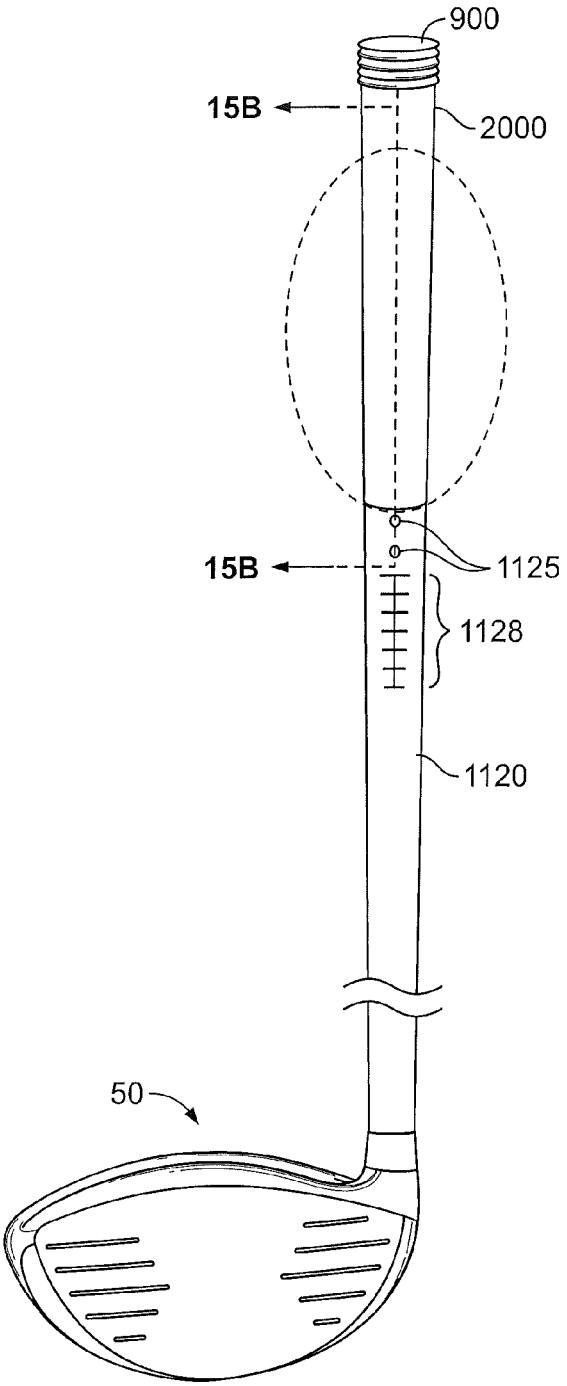
FIG. 15A is an assembled, side plan view of the embodiment shown in FIG. 13.
Figure 15B:
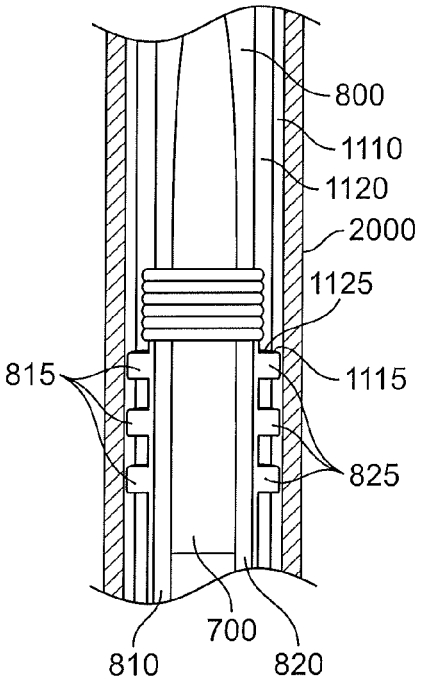
FIG. 15B is a cross-sectional view of the circled part of the embodiment shown in FIG. 15A along lines 15B-15B.

As shown in FIG. 13, and in more detail in FIGS. 14A and 14B, the prongs 810, 820 of the engaging insert 800 preferably each comprise a plurality of protrusions 815, 825 facing away from each other. As shown in FIG. 15A, and in greater detail in FIG. 15B, when this embodiment of the variable length shaft 1000 is fully assembled and a length is selected by lining up a chosen plurality of holes 1125 on the lower shaft piece 1120 with the plurality of holes 1115 on the upper shaft piece 1110, the upper shaft piece 1110 is semi-permanently attached to the lower shaft piece 1120 by inserting the locking bar 700 into the engaging insert 800, thereby pushing the prongs 810, 820 apart and forcing the protrusions 815, 825 into the plurality of holes 1125 on the lower shaft piece 1120 and the plurality of holes 1115 on the upper shaft piece 1110, all of which are proximate the protrusions 815, 825.

The tool 750 is then removed from the locking bar 700, which is left inside the engaging insert 800 to semi-permanently fix the upper shaft piece 1110 to the lower shaft piece 1120 at the desired overall length. If a user wishes to adjust the overall length of the variable length shaft 1000, the tool 750 can be used to remove the locking bar 700 so that the upper shaft piece 1110 can be slid along the lower shaft piece 1120 again.

Once the variable length shaft 1000 of this embodiment is assembled, the open upper end 1111 of the upper shaft portion 1110 can be closed off with a cap 900, which may be weighted to adjust the overall weight of the variable length shaft 1000. The cap 900, which preferably is approximately 0.40 inch long, may be affixed to the open upper end 1111 by any means, but is preferably affixed with mating threads, which may be disposed on interior or exterior surfaces of both the cap 900 and the upper shaft portion 1110.

A fourth, preferred embodiment of the present invention, which also does not require multiple upper shaft or grip pieces having varying lengths, is shown in FIGS. 16A, 16B, 17, and 18. This embodiment is even lighter in weight than the third embodiment because it does not include an engaging insert 800, nor does it include a locking bar 700 that is retained within the shaft 1000 to semi-permanently fix the upper shaft piece 1110 to the lower shaft piece 1120.

Figure 16A:
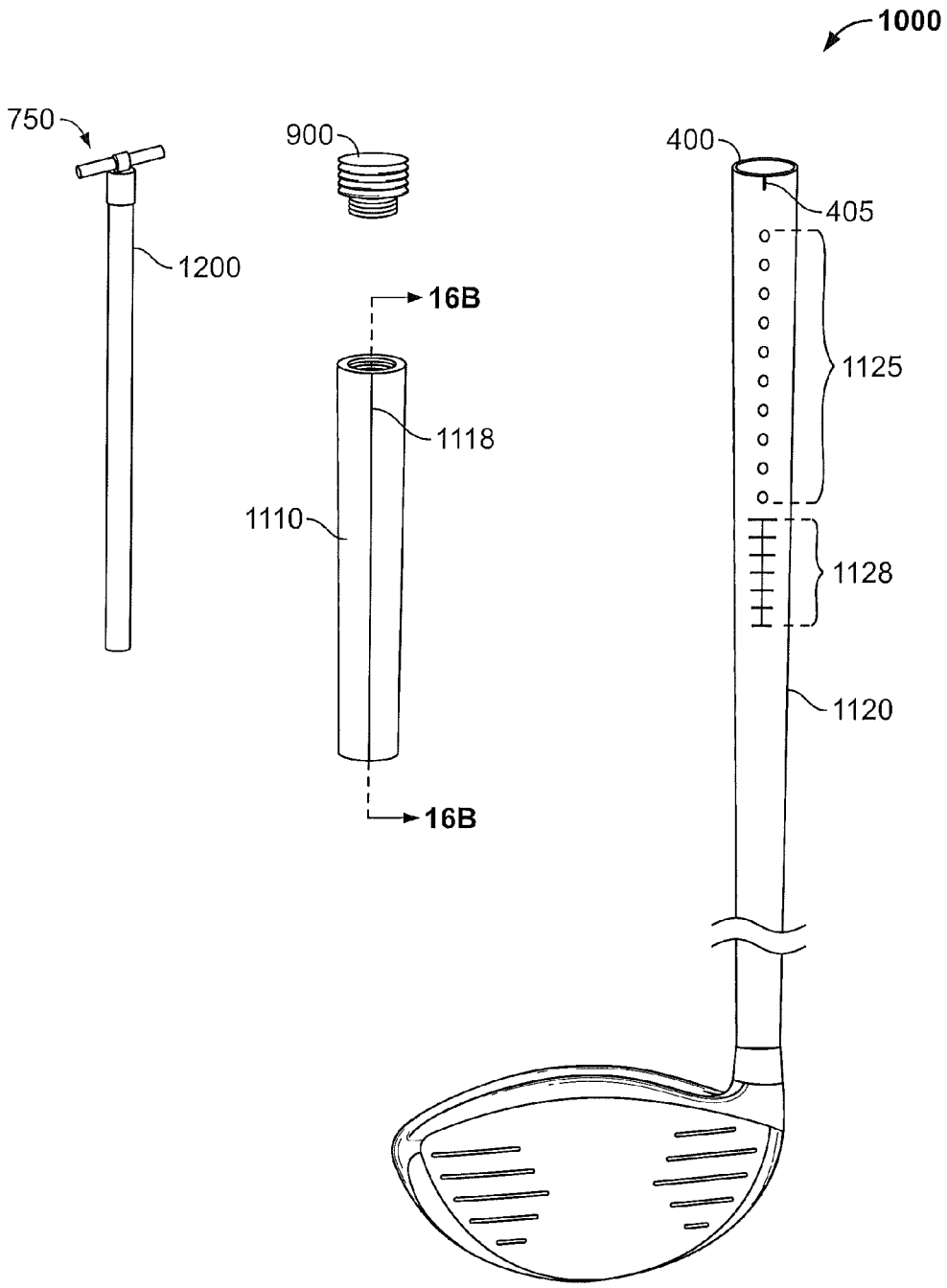
FIG. 16A is an unassembled, side plan view of the elements of a fourth embodiment of the present invention.
Figure 16B:
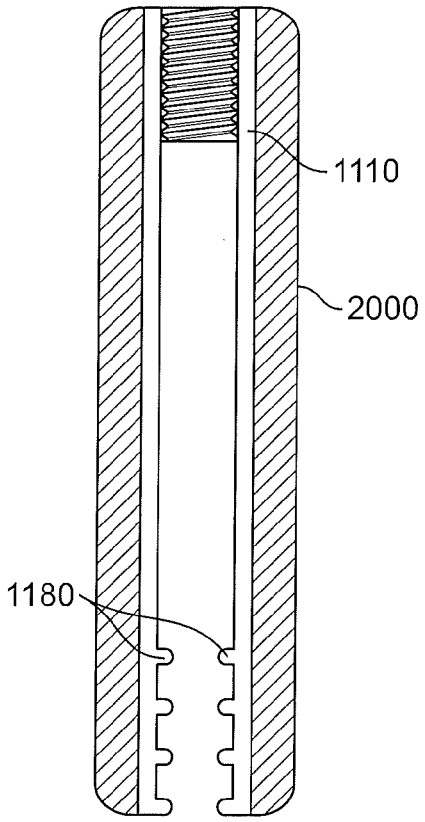
FIG. 16B is a cross-sectional view of the upper shaft piece shown in FIG. 16A along lines 16B-16B
Figure 17:
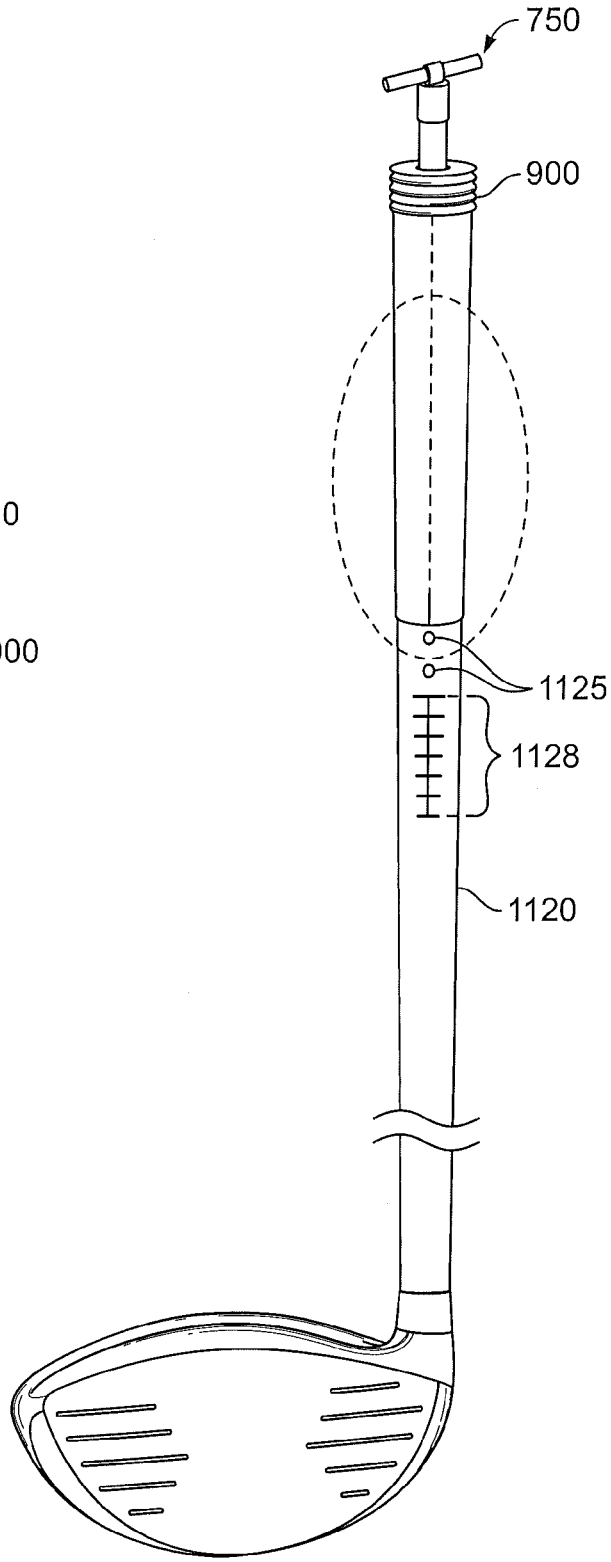
FIG. 17 is a side plan view of the assembled embodiment shown in FIG. 16A.

As shown in FIGS. 16A and 16B, the preferred embodiment of the variable length shaft 1000 includes the same lower shaft piece 1120 as the third embodiment, including the plurality of holes 1125 and length markings 1128, and an upper shaft piece 1110 having protrusions 1180 extending from at least two sides of its internal surface. The upper shaft piece 1110 may also include a longitudinal slit 1118 to accommodate its sliding over the exterior surface of the lower shaft piece 1120. As in the third embodiment, a protruding edge 405 of a locating clip 400 disposed on the lower shaft piece 1120 can engage the longitudinal slit 1118 to guide the movement of the upper shaft piece 1110 and prevent it from twisting.

Figure 18:
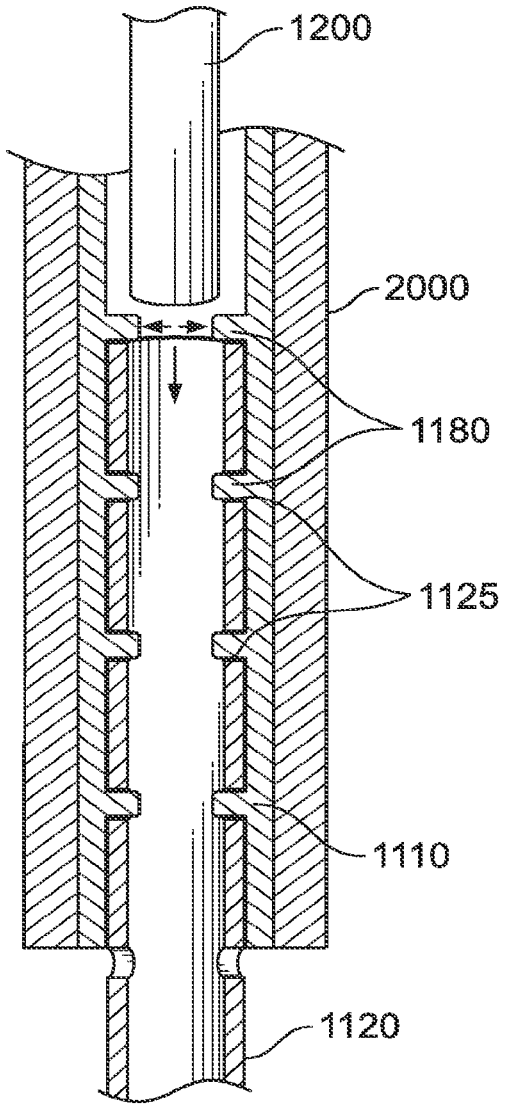
FIG. 18 is a cross-sectional view of the circled part of the embodiment shown in FIG. 17, showing the unlocking bar engaging the upper and lower shaft pieces.

The upper shaft piece 1110 is sized to snugly grip the lower shaft piece 1120, and the protrusions 1180 on the interior surface of the upper shaft piece 1110 engage the plurality of holes 1125 on the lower shaft piece 1120 upon encountering them. As shown in FIGS. 16A and 18, an unlocking bar 1200 is used to disengage the protrusions 1180 from the plurality of holes 1125 and allow the upper shaft piece 1110 to slide along the length of the lower shaft piece. The unlocking bar 1200 has a diameter that is large enough to push the protrusions 1180 out of the holes 1125 and permit the upper shaft piece 1110 to slide along the lower shaft piece, 1120, but small enough to fit within both the upper shaft piece 1110 and the lower shaft piece 1120. The unlocking bar 1200 may have ridges or small protrusions (not shown) on its own exterior surface to further assist in pushing the protrusions 1180 out of the holes 1125. The unlocking bar 1200 preferably pushes the protrusions 1180 out of the holes 1125 far enough to permit the upper shaft piece 1110 to slide along the lower shaft piece 1120, but the protrusions 1180 preferably engage the holes 1125 briefly during sliding long enough to create a clicking or ratcheting sound, which indicates to the user where the holes 1125 are, and thus the locations at which the upper shaft 1110 can be fixed along the lower shaft 1120.

The pieces of the variable length shaft and grip of the various embodiments of the present invention may be composed of one or more of any number of materials, including metals, plastics, rubbers, urethanes, and composites, and may have any number of dimensions so long as they are sized to achieve the functions described herein. The shaft portions 110, 120 610, 660, 1110, 1120, locking bar 700, engaging insert 800, locating clip 400, and the bolts 300, 310 may be composed of titanium, graphite or carbon composite, plastic, magnesium, aluminum, steel, or alloys of such materials, specifically stainless steel 17-7 or titanium 6-4. The shaft portions 110, 120 610, 660, 1110, 1120, locking bar 700, unlocking bar 1200, and engaging insert 800 preferably are composed of graphite. The grip portions 210, 220 preferably are composed of rubber material and the expandable bushing 180 and elastic connector 850 are preferably composed of urethane. The cap 900 preferably is composed of both metal and plastic materials, and the bolts 300, 300, and the locating clip 400 preferably are composed of a metal material. The pieces of the variable length shaft and grip disclosed herein may also be bonded together with an adhesive to prevent unwanted separation and ensure adequate strength during club use. The variable length shaft and grip disclosed herein may be used with any type of golf club head, including irons, woods, and putters.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A variable length golf club shaft comprising:

a hollow lower shaft comprising a wall having a plurality of holes;

a hollow upper shaft comprising an exterior surface and an interior surface, wherein the interior surface comprises at least one protrusion sized to fit within at least one of the plurality of holes, and wherein the upper shaft is sized to slidably receive the lower shaft; and an unlocking bar sized to fit within the upper shaft and the lower shaft, wherein sliding the upper shaft over the lower shaft causes the protrusion to engage with at least one of the plurality of holes, wherein engagement of the protrusion with one or more of the plurality of holes fixes the upper shaft to the lower shaft, and wherein inserting the unlocking bar into the upper shaft and the lower shaft when the upper shaft is fixed to the lower shaft disengages the protrusion from the one or more plurality of holes and permits the upper shaft to move along a length of the lower shaft.

2. The variable length golf club shaft of claim 1, wherein the plurality of holes comprises at least ten holes each on at least two opposing sides of the lower shaft wall, and wherein the interior surface of the upper shaft comprises at least three protrusions each on at least two opposing sides of the interior surface.

3. The variable length golf club shaft of claim 2, wherein the lower shaft comprises a longitudinal axis, wherein the plurality of holes is arranged along the longitudinal axis of the lower shaft, wherein the upper shaft comprises a longitudinal axis that is coaxial with the longitudinal axis of the lower shaft, and wherein the protrusions are arranged along the longitudinal axis of the upper shaft.

4. The variable length golf club shaft of claim 1, wherein sliding the upper shaft along the lower shaft adjusts an overall length of the variable length golf club shaft, and wherein the variable length golf club shaft allows for overall length adjustment in the range of 3 inches.

5. The variable length golf club shaft of claim 1, wherein the upper shaft and lower shaft are each composed of a composite material.

6. The variable length golf club shaft of claim 1, further comprising a grip affixed to the exterior surface of the upper shaft.

7. The variable length golf club shaft of claim 1, further comprising a weighted cap, wherein the upper shaft comprises an opening at an upper end and an opening at a lower end, wherein the opening at the lower end receives the lower shaft, and wherein the opening at the upper end receives the weighted cap.

8. A variable length golf club shaft comprising:

a hollow upper shaft composed of a composite material, the upper shaft comprising an exterior surface, an interior surface, a longitudinal axis, a plurality of protrusions arranged along the longitudinal axis on opposing sides of the interior surface, a slit extending along the longitudinal axis, an open upper end, and an open lower end;

a hollow lower shaft composed of a composite material and sized to fit within the upper shaft, the lower shaft comprising a wall, a plurality of through holes arranged along a longitudinal axis on opposing sides of the wall, an open upper end, and a lower end for engagement with a golf club head;

a locating clip disposed at the open upper end of the lower shaft, the locating clip comprising a protruding edge that mates with the slit;

a grip affixed to the exterior surface of the upper shaft, the grip comprising an open upper end;

a cap sized to fit within the open upper end of the grip and the open upper end of the upper shaft; and an unlocking bar sized to fit within the lower shaft and the upper shaft, wherein inserting the lower shaft into the upper shaft so that the protrusions interact with the plurality of through holes fixes the upper shaft to the lower shaft, and wherein inserting the unlocking bar into the upper shaft and the lower shaft when the upper shaft is fixed to the lower shaft pushes the protrusions out of the plurality of through holes and permits the upper shaft to move along a length of the lower shaft.

9. The variable length golf club shaft of claim 8, wherein the cap comprises external threads, wherein the open upper end of the upper shaft comprises internal threads sized to receive the external threads, and wherein the cap is weighted to adjust the overall weight of the variable length golf club shaft.

10. The variable length golf club shaft of claim 8, wherein the grip is composed of a rubber material and the locating clip is composed of a lightweight metal material.

* * * * *